United States Patent [19]

Humberstone et al.

[11] Patent Number: 4,532,197

[45] Date of Patent: Jul. 30, 1985

[54] INTENSE PRE-ILLUMINATION ELECTROPHOTOGRAPHIC PROCESS

[75] Inventors: Victor C. Humberstone, Sawston; John H. Fisher, Whaddon, Nr. Royston, both of England

[73] Assignee: Comtech Research Unit Limited, Hamilton, Bermuda

[21] Appl. No.: 495,251

[22] Filed: May 17, 1983

[30] Foreign Application Priority Data

May 18, 1982 [GB] United Kingdom ..... 8214428

[51] Int. Cl.[3] ..... G03G 13/052; G03G 13/22

[52] U.S. Cl. ..... 430/41; 430/54; 430/31

[58] Field of Search ..... 430/31, 54, 55, 41

[56] References Cited

U.S. PATENT DOCUMENTS 3,909,254 9/1975 Tamai et al. ..... 430/31

*Primary Examiner*—John L. Goodrow

*Attorney, Agent, or Firm*—Poms, Smith, Lande & Rose

[57] ABSTRACT

A method of forming an image on an electrophotographic film material is described. This involves a contact printing technique and comprises the following steps:

(a) placing an image-bearing master in contact with the film;

(b) exposing the film to light through the image-bearing master, the exposure being substantially greater than the minimum necessary to render conductive the photo-conductive layer of the electrophotographic film;

(c) applying a substantially uniform charge to the surface of the film in the dark immediately after exposure;

(d) leaving the film in the dark for a short time so as to allow the charge to migrate selectively; and (e) then developing the image.

6 Claims, 1 Drawing Figure

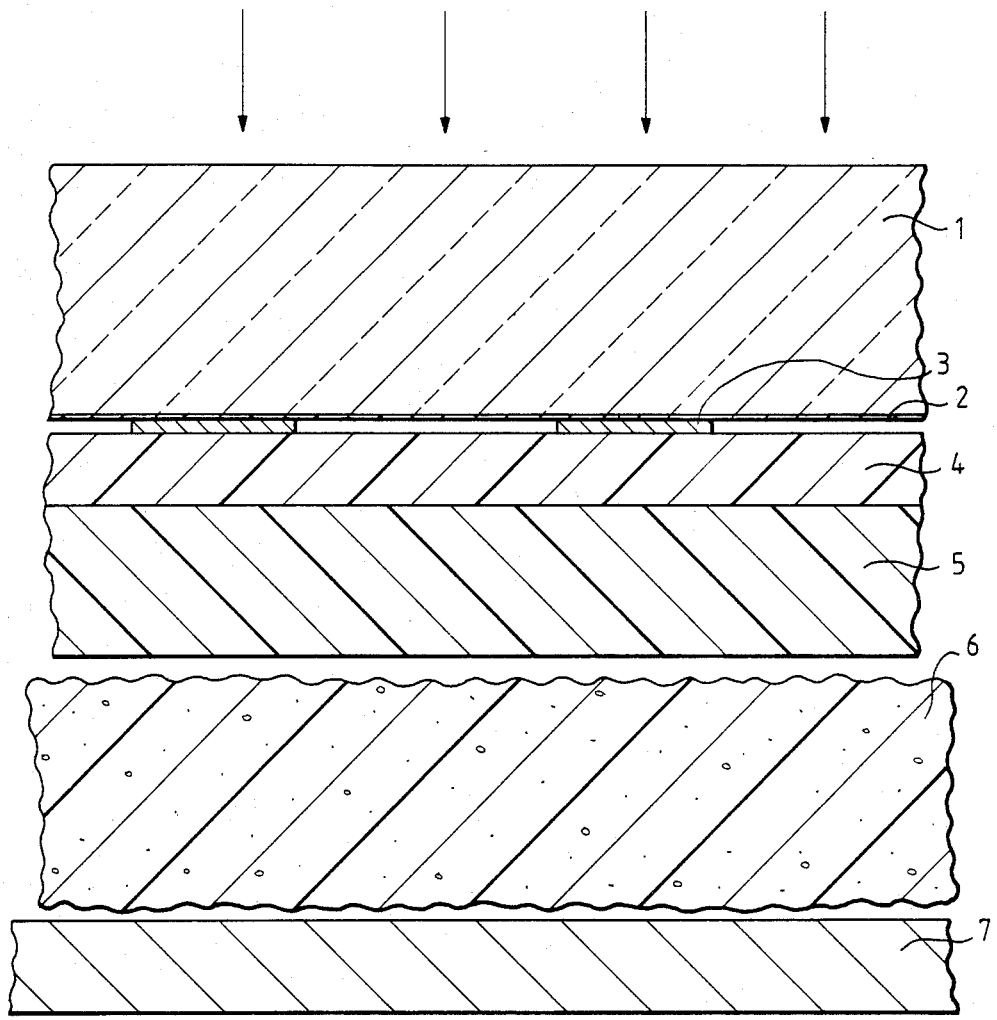
1
3
2
4
5
6
7

INTENSE PRE-ILLUMINATION ELECTROPHOTOGRAPHIC PROCESS

This invention relates to electrophotography and, more particularly, is concerned with contact printing onto electrophotographic films, e.g. TEP and image migration materials.

In many branches of photography it is necessary to print part of the area of many pieces of photographic material with a standardised image before that material is given its principal exposure. A familiar example is the printing of frame numbers on 35 mm film as commonly used in cassettes. A more demanding necessity exists in micro-photographic recording when it is necessary in many recording systems to pre-print, on a large sheet of material, a coordinate system which enables any one microscopic image out of many (for example out of several thousands) to be located quickly and accurately.

An additional problem in micro-photographic recording is that it may be a requirement to expose, develop and view only a few images on any one occasion, further images being added at later times. While it is not in principle impossible to do so with conventional silver halide or diazo photography it is, in practice, difficult and hence costly to confine developing and fixing chemicals to the areas of individual images which may have dimensions of only a few mm, e.g. 2 mm×4 mm.

By using a TEP material, it is possible more easily to process one image occupying only a part of the photographic material without adversely affecting adjacent areas of the material whether they be exposed or unexposed. However, difficulties arise in pre-printing these electrophotographic materials with a coordinate system.

The coordinate system will generally need to be printed with high accuracy and excellent definition over a large area. With silver halide or diazo photographic materials, the obvious way to achieve this would be by way of contact printing. However, there are serious difficulties involved in contact printing onto electrophotographic materials. These difficulties are associated with charge transfer or tribo-electric generation of charge while the master is in contact with, or is being separated from, the material being printed.

In the conventional use of electrophotographic materials there are three stages in the production of an image. These are:

(a) applying in electrostatic charge uniformly over the surface of the material;

(b) exposing the material imagewise to light; and (c) developing the image.

With transparent electrophotographic (TEP) films, the developing is usually effected by application of toner particles which are then fused to form the image. With migration photographic materials, for example the material "XDM" sold by Xerox Corporation, developing is usually effected by heating. The significance of the sequence of steps which results in the production of an image is that the imagewise exposure of the photoconductive layer in the electrophotographic material allows the surface electrostatic charge to leak away, or (in migration image photography) to transfer to the dark particles, because the photoconductive material becomes temporarily conductive.

We have developed a method of forming an image on an electrophotographic film by a contact printing technique which method is applicable to forming an image on a preselected part of the film material and in which processing can be applied to the whole of the film in order to form the image without adversely affecting the remainder of the film, regardless of whether or not the remainder of the film has been exposed or is unexposed. More particularly, the present invention provides, in one aspect, a method of forming an image on an electrophotographic film by a contact printing technique, which comprises:

(a) placing an image-bearing master in contact with the film;

(b) exposing the film to light through the image-bearing master, the exposure being substantially greater than the minimum necessary to render conductive the photoconductive layer of the electrophotographic film;

(c) applying a substantially uniform charge to the surface of the film in the dark immediately after exposure;

(d) leaving the film in the dark for a short time so as to allow the charge to migrate selectively; and (e) then developing the image.

The term "light" is used herein to mean any form of radiation which can activate the photoconductive layer by making it electrically conductive.

The exposure in step (b) above is preferably very long and intense. In the normal practice of this invention, the exposure will usually be from 500 to 50,000 times the normal exposure for the electrophotographic material in use. A factor of the order of 10,000 times the normal exposure has been found to be particularly advantageous.

We have found that, using commercially available materials, the method defined above in which intense exposure is used gives the result that, after exposure, the photoconductive material remains electrically conductive for a limited time. It is thus possible to charge the surface e.g. by Corotron, after exposure, then to leave the film a little longer to allow the charge to migrate selectively, and then to develop the image. Since TEP and image migration materials do not require a chemical fixing process, the whole area of the film material may be processed each time a selective area is provided with an image, without degrading any existing images or harming unexposed areas of the film.

In another aspect, the invention provides a method of adding an image to an electrophotographic film which has one or more images pre-recorded on areas thereof, which comprises (a) placing a master carrying the desired image into contact with a previously unexposed region of the film; (b) exposing the whole of the film to light through the image-bearing master, the exposure being substantially greater than the minimum necessary to achieve conductivity in the photoconductive layer of the electrophotographic film; (c) applying a substantially uniform charge to the whole surface of the film in the dark; (d) leaving the film in the dark for a short time to allow selective migration of the charge; and (e) then applying an appropriate developing process to the whole surface of the film.

As in the first aspect of the invention defined earlier, the exposure in step (b) is preferably very long and intense; again, a factor of the order of 10,000 times the normal exposure has been found to be particularly advantageous.

The invention will be further described with reference to the accompanying drawing, in which there is shown a cross-sectional view (greatly enlarged)

through a master and a TEP film. In the drawing, a master in the form of a glass substrate 1 carrying an image in the form of areas 3 of chromium is in surface-to-surface contact with a TEP film comprising a photoconductive layer 4 and a substrate 5. The master is in fact coated on its lower surface (as seen in the drawing) with a layer of chromium 2, but this layer is thin enough to be optically transparent except in the region of the image elements 3.

In practice, the TEP film is held between the master and an open-cell foam pad 6 which is mounted onto a rigid baseplate 7. The foam 6 is sculpted into a rounded shape so that as the master is clamped against the TEP film, no significant amounts of air are entrapped between the TEP and the master, which could degrade the quality of the image produced in the TEP film.

A large imagewise exposure is made through the chromium-on-glass master. In this particular example, the TEP film was type P5-003, manufactured and sold by James River Graphics of Massachusetts, USA. The normal exposure for this material is 20 microjoules per square centimeter at a wavelength of 580 nm. The exposure used in this example was 0.2 joules per square centimeter in total (all wavelength) which corresponds approximately to an exposure of 1–10 millijoules per square centimeter at 580 nm.

The exposure was effected using a 1000 watt tungsten halogen projection lamp incorporating an integral reflective parabolic focussing mirror. The lamp was placed 0.6 meters from the exposure station (i.e. from the master).

After exposure, a substantially uniform charge was applied to the surface of the exposed TEP film. There was no apreciable delay between the exposure step and this charging step—i.e. the one followed immediately after the other. The TEP film was then left in the dark for a short time to allow the charge to migrate selectively, after which the TEP film was subjected to conventional processing to give a copy of the master. The resultant copy was an exact copy of the original with no significant degradation of the image.

We claim:

1. A method of forming an image on a transparent electrophotographic or image migration film by a contact printing technique, which comprises:

(a) placing an image-bearing master in surface to-surface contact with the film;

(b) exposing the film to light through the image-bearing master, the exposure being at least 500 times greater than the minimum necessary to render conductive the photoconductive layer of the electrophotographic film;

(c) applying a substantially uniform charge to the surface of the film in the dark immediately after exposure;

(d) leaving the film in the dark for a short time so as to allow the charge to migrate selectively; and (e) then developing the image.

2. A method of adding an image to a transparent electrophotographic or image migration film which has one or more images pre-recorded on areas thereof, which comprises (a) placing a master carrying the desired image into surface to-surface contact with a previously unexposed region of the film; (b) exposing the whole of the film to light through the image-bearing master, the exposure being at least 500 times greater than the minimum necessary to achieve conductivity in the photoconductive layer of the electrophotographic or image migration film; (c) applying a substantially uniform charge to the whole surface of the film in the dark; (d) leaving the film in the dark for a short time to allow selective migration of the charge; and (e) then applying an appropriate developing process to the whole surface of the film.

3. A method according to claim 2, wherein the exposure is about 10,000 times the normal exposure for the material in use.

4. A method according to claim 2 wherein the exposure in step (b) is from 500 to 50,000 times the minimum necessary to achieve conductivity in the photoconductive layer of the electrophotographic material.

5. A method of adding an image to a transparent electrophotographic or image migration film which has one or more images pre-recorded on areas thereof, which comprises (a) placing a master carrying the desired image into surface-to-surface contact with a previously unexposed region of the film; (b) exposing the whole of the film, having certain images already on at least a portion of the film, to light through the image-bearing master by the application of a broad area non-coherent light source, the exposure being 500 to 50,000 times greater than the minimum necessary to achieve conductivity in the photoconductive layer of the transparent electrophotographic or image migration film; (c) applying a substantially uniform charge to the whole surface of the film in the dark; (d) leaving the film in the dark for a short time to allow selective migration of the charge; and (e) then applying an appropriate developing process to the whole surface of the film.

6. A method according to claim 1, wherein the exposure in step (b) is from 500 to 50,000 times the minimum required to achieve conductivity in the photoconductive layer of the electrophotographic material.

* * * * *